United States Patent [19]

Leuchter

[11] 4,060,873

[45] Dec. 6, 1977

[54] APPARATUS FOR REMOVING LIQUIDS FROM MOVING STRIPS OF PHOTOGRAPHIC MATERIAL OR THE LIKE

[75] Inventor: Jurgen Leuchter, Tutzing, Germany

[73] Assignee: AGFA-Gevaert Aktiengesellschaft, Leverkusen, Germany

[21] Appl. No.: 696,200

[22] Filed: June 15, 1976

[30] Foreign Application Priority Data

June 20, 1975 Germany ..... 2527560
Oct. 10, 1975 Germany ..... 2545487

[51] Int. Cl.[2] ..... G03D 5/00
[52] U.S. Cl. ..... 15/256.5; 15/100
[58] Field of Search ..... 15/100, 102, 77, 256.5, 15/256.6; 352/130

[56] References Cited

U.S. PATENT DOCUMENTS

| | | | |
|---|---|---|---|
| 2,623,225 | 12/1952 | Frankel | 15/100 |
| 2,796,618 | 6/1957 | Arndt | 15/100 |
| 3,189,929 | 6/1965 | Koppehele | 15/100 X |
| 3,878,578 | 4/1975 | Skudrna | 15/102 |

FOREIGN PATENT DOCUMENTS

| | | | |
|---|---|---|---|
| 2,051,363 | 4/1972 | Germany | 15/100 |

*Primary Examiner*—Edward L. Roberts
*Attorney, Agent, or Firm*—Peter K. Kontler

[57] ABSTRACT

Strips of photographic material which are treated during travel through liquid baths in a developing machine are relieved of surplus liquid during travel from a preceding bath into the next-following bath. The intercepting apparatus has a wiper with two elastic intercepting members engaging the respective sides of the moving strip and a pivotable support for the wiper. The support can move transversely of the direction of movement of the strip in order to insure that the intercepting members remain in continuous engagement with a fluttering strip as well as with a strip moving along a path which deviates from the path of movement of the preceding strip. The wiper is detachable from its support for convenience of cleaning. Each intercepting member has a strip-engaging lip which can resemble a wedge or a flat lamina and is connected to the adjacent part of the respective intercepting member by a flexible hinge.

21 Claims, 6 Drawing Figures

APPARATUS FOR REMOVING LIQUIDS FROM MOVING STRIPS OF PHOTOGRAPHIC MATERIAL OR THE LIKE

BACKGROUND OF THE INVENTION

The present invention relates to apparatus for removing liquids from strips of photographic material or the like. More particularly, the invention relates to improvements in apparatus for removing liquid films and/or droplets from moving strips or webs which issue from liquid baths.

A developing machine for exposed photographic films includes a plurality of receptacles each of which contains a different liquid bath and rolls or analogous means for guiding and transporting exposed film strips seriatim through successive baths. The machine is normally designed for treatment of film strips having different thicknesses and/or widths. The receptacles contain liquids which perform a developing, fixing, bleaching, washing and/or other function. Recent types of developing machines further comprise intercepting devices or apparatus which prevent the moving strip from entraining liquid films or droplets from a preceding receptacle into the next-following receptacle. Removal of liquid films or droplets which adhere to the sides of a moving strip is desirable and often necessary because the baths contain different chemicals which, when introduced into the next-following receptacle or receptacles, could change the consistency of the respective baths and adversely influence the developing process. Each bath is intended to contact successive increments of the moving strip for a given period of time which is considered necessary to insure an optimum treatment of the strip in the respective receptacle. The length of intervals during which a given increment of the moving strip is held in contact with a particular liquid depends on the length of the path portion along which an increment of the strip moves during travel through a bath as well as on the speed of lengthwise movement of the strip. As a rule, the speed of the strip is constant or nearly constant so that the influence of chemicals upon the strip can be changed by changing the concentration or nature of chemicals in the receptacles and/or by changing the length of that portion of the path for the strip which extends through the contents of a receptacle. Under normal circumstances, the concentration of chemicals in various receptacles of the developing machine remains or should remain constants, i.e., it should change only as a result of interaction between such chemicals and the moving strip. The developing machine comprises means for suppling to the receptacles fresh liquids at regular or irregular intervals as well as means for regenerating the liquids which are withdrawn from certain receptacles. The extent to and the frequency at which the liquid in a given receptacle must be regenerated depends, among others, on the quantity of liquid which the moving strip removes from the receptacle and also on the quantity of liquid which the sides of the moving strip entrain into such receptacle from the preceding receptacles. In most instances, the quality of liquid in a given receptacle undergoes rapid and radial changes if the strip is permitted to introduce substantial quantities of liquid from the preceding receptacle or receptacles.

The aforedescribed conventional intercepting devices or apparatus for preventing the transfer of liquids from preceding into the next-following receptacles of a developing machine are not entirely satisfactory because they are incapable of removing sufficient quantities of liquid and/or because they are likely to scratch or otherwise deface or damage the moving strip. The conventional intercepting apparatus are normally mounted in regions where successive increments of a moving strip emerge from the liquid baths so that the intercepted liquids can be readily returned into the respective receptacles. Moreover, such mounting of the intercepting apparatus insures that the liquid in the next-following receptacle or receptacles can act upon successive increments of the strip as soon as such increments enter the liquid bath or baths; this will be readily understood since the liquid in a second bath can come into immediate contact with both sides of the moving strip if the sides were relieved of surplus moisture and eventually allowed to dry prior to entry into the next bath.

In accordance with a presently known proposal, the liquid intercepting apparatus is mounted upstream or ahead of the last guide roll for the film strip in a given receptacle of the developing machine. The intercepting apparatus includes a fixedly mounted bracket for two elastic liquid-intercepting members which are mounted on the bracket opposite each other so as to engage and wipe the respective sides of the moving strip. The moving strip flexes the lips of the intercepting members so that lips form a narrow passage whose width decreases in the direction of movement of the strip. A drawback of such devices is that the pressure with which one of the lip bears against one side of the moving strip equals or closely approximates the pressure with which the other lip bears against the other side of the strip only when the strip is guided with a very high degree of accuracy, i.e., when successive increments of the strip do not move sideways from a predetermined path. This can be achieved only when the developing machine is to process single type of strips. If the thickness and/or width of strips varies, successive increments of the strips are likely to move sideways from the predetermined optimum path so that liquid-intercepting action of one lip is much more pronounced than that of the other lip. The aforementioned last guide roll is normally formed with a concave peripheral surface so that a relatively narrow film moves closer to its axis than a relatively wide film; consequently, the path along which a wide strip advances through the liquid intercepting station deviates from the path for a relatively narrow film. Another reason for deviations of the path along which the strip moves through the liquid intercepting station from an optimum path is that the strip exhibits a tendency to flutter during movement from a preceding guide roll toward the next-following guide roll. The fluttering becomes more pronounced when the strip must move along or through an obstruction which tends to retard or brake its lengthwise movement and the braking or retarding action of such obstruction is thereupon terminated abruptly rather than gradually.

SUMMARY OF THE INVENTION

An object of the invention is to provide a novel and improved apparatus for removing liquid droplets and/or films from moving strips of photographic material or the like, particularly for removing developing, fixing, bleaching and/or other liquids from exposed photographic films in developing machines, which is capable of insuring predictable interception of liquids which are entrained by relatively wide, relatively narrow, relatively thick and/or relatively thin strips.

Another object of the invention is to provide an apparatus whose operation is not influenced by fluttering of strips during travel toward and through the intercepting station and which can intercept and remove liquid films and/or droplets from rapidly or slowly advancing strips without any defacing of and/or other damage to the strips.

A further object of the invention is to provide an apparatus wherein the liquid-contacting parts are readily accessible for inspection, removal, replacement and/or cleaning.

An additional object of the invention is to provide the apparatus with novel and improved liquid-intercepting members and with novel and improved means for supporting the intercepting members.

Still another object of the invention is to provide an apparatus which can be used for interception of liquid films and/or droplets in existing developing machines for strips of photographic material or the like.

Another object of the invention is to provide a developing machine for strips of exposed photographic films or papers which embodies one or more improved liquid intercepting apparatus.

An ancillary object of the invention is to provide an apparatus which is not likely to break a moving strip and which is constructed and assembled in such a way that a splice or another enlarged portion of the strip can pass through the intercepting station without any danger of damage to the strip and/or to component parts of the intercepting apparatus.

A further object of the invention is to provide an apparatus whose liquid intercepting member or members are not likely to scratch the film and whose intercepting members can be cleaned at frequent intervals to prevent incrustation or crystallizing of intercepted liquid substances thereon.

The invention is embodied in a machine wherein elongated strips are moved seriatim lengthwide through a succession of liquid baths and wherein at least some of the strips exhibit the tendency to move sideways, particularly in a developing machine for strips of exposed photographic material. The machine comprises at least one liquid-containing receptacle or vessel (e.g., a tank for a photographic developing or fixing solution), rolls and/or other devices for guiding a moving strip along a predetermined path which extends through and beyond the receptacle so that the moving strip contacts the liquid in the receptacle and successive increments of the strip entrain some of the liquid on leaving the contents of the receptacle, and a novel and improved apparatus for removing at least some of the entrained liquid from such increments.

The apparatus includes wiper means having at least one liquid-intercepting member (e.g., a flap or strip made at least in part of elastomeric material) which is in contact with one side of each increment emerging from the body of liquid in the receptacle, and support means for the wiper means. The support means and/or the wiper means is movable substantially transversely of the path so as to enable the intercepting member to remain in continuous and substantially unchanged liquid-intercepting contact with the one side of the moving strip irrespective of eventual sidewise movement of successive increments of the strip in the region of the wiper means. The wiper means preferably comprises two liquid-intercepting members which are located at the opposite sides of the path for the moving strip, and the support means for the wiper means preferably constitutes a pendulum which can turn about a fixed pivot axis so as to enable both intercepting members to remain in continuous contact with the respective sides of the moving strip.

The novel features which are considered as characteristic of the invention are set forth in particular in the appended claims. The improved apparatus itself, however, both as to its construction and its mode of operation, togethere with additional features and advantages thereof, will be best understood upon persual fo the following detailed description of certain specific embodiments with reference to the accompanying drawing.

DESCRIPTION OF THE PREFERRED EMBODIMENTS

Figure 2:
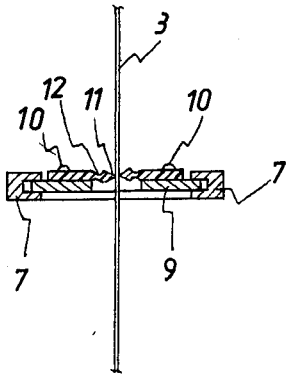
FIG. 2 is a sectional view substantially as seen in the direction of arrows from the line II—II of FIG. 1*a;*
Figure 1A:
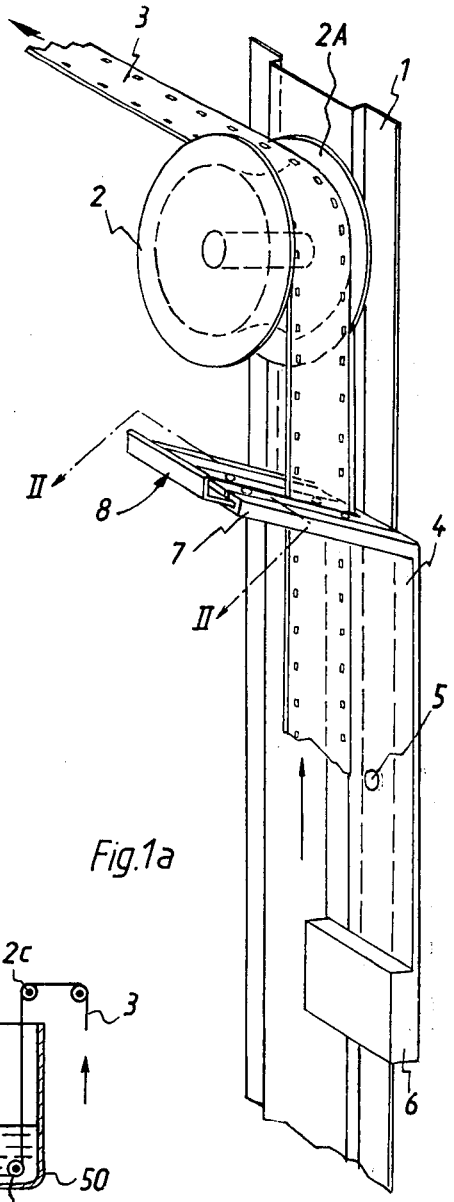
FIG. 1*a* is an enlarged perspective view of one of the intercepting apparatus shown in FIG. 1.
Figure 1:
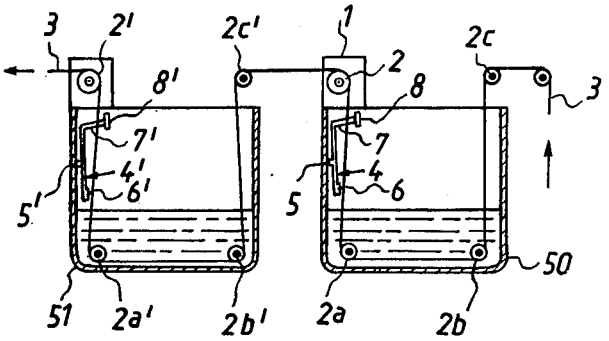
FIG. 1 is a schematic sectional view of a portion of a developing machine which is provided with two liquid intercepting apparatus each embodying one form of the invention.

Referring first to FIGS. 1, 1*a* and 2, FIG. 1 shows a portion of a developing machine for strips 3 of exposed photographic material. The machine includes several receptacles including a first receptacle 50 and a second receptacle 51. It is clear that the machine may comprise (and normally comprises) three or more receptacles each of which contains a different body of liquid. The receptacle 50 (and/or a frame 1 which is also shown in FIG. 1*a*) supports several guide rolls 2, 2*a*, 2*b*, 2*c* which define a portion of an elongated path along which successive strips 3 are moved lengthwise through and beyond the liquid bath in the receptacle 50. Similar guide rolls 2', 2*a'*, 2*b'*, 2*c'* are provided in the receptacle 51 and/or on the respective frame to define a second portion of the aforementioned path, i.e., that portion along which a strip moves during transport through the liquid path in the receptacle 51.

The guide roll 2 is mounted on the frame 1 above the level of the liquid bath in the receptacle 50. This guide roll has a concave peripheral surface 2A so that a relatively narrow strip 3 moves nearer to its axis than a relatively wide strip. Consequently, that portion of the path for the strip 3 which is located immediately ahead of the guide roll 2 (the strip is assumed to be transported upwardly, as viewed in FIG. 1 or 1*a*) is defined with a high degree of accuracy only if the machine processes strips of a given width; if the width of the stips is changed, the aforementioned portion of the path for the strip 3 moves to the right or the left, as viewed in FIG. 1. The path portion immediately downstream of the roll 2 is substantially horizontal.

The frame 1 further supports a pendulum-shaped bracket or support 4 which can turn about the horizontal axis of a pivot member 5 and includes an upper portion having an upwardly sloping slotted rail 7 and a lower portion having a counterweight 6 which balances the weight of the upper portion and of a wiper 8 which is detachably mounted on the rail 7. The center of gravity of the apparatus including the support 4 and the wiper 8 is located below the pivot member 5; therefore, the counterweight 6 tends to maintain the support 4 in a predetermined angular position, i.e., in that position in which the liquid-intercepting members 10 of the wiper 8 are located at the opposite sides of the path of movement of a strip 3 having an average width so that such strip is located at a known distance from the axis of the guide roll 2. The rail 7 constitutes a holder for the removable wiper 8. As shown, the rail 7 may be provided with bend-over marginal portions which define elongated channels for the respective marginal portions of the arms of a bifurcated yoke-like carrier 9 for the intercepting members 10.

The details of the wiper 8 and rail 7 are shown in FIG. 2. Th liquid intercepting members 10 consist, at least in part, of rubber or other suitable elastomeric material which can be flexed by the moving strip 3. Each of the these intercepting members has a narrow end portion or lip 11 which engages the respective side of the moving strip 3 and at least one weakened portion 12 (e.g., a web flanked by two grooves or recesses) which is adjacent to and parallel with the respective lip. The lips 11 and the weakened portions 12 extend transversely of the path of movement of the strip 3. The lips 11 preferably resemble wedges which taper in directions toward the respective sides of the strip 3. The carrier 9 is U-shaped and each of is two flanges or arms carries one of the intercepting members 10 which can be secured thereto by an adhesive or in any other suitable fashion. The minimum distance between the two lips 11 (in the absence of a strip 3 therebetween) is preferably very small, e.g., in the range of 0.1 millimeter. If the thickness of the strip 3 exceeds 0.1 millimeter, the end portions of the lips 11 are flexed by the moving strip to intercept the liquid films and/or droplets at the respective sides of the strip. The intercepted liquid descends into the receptacle 50.

The operation:

The strip 3 is threaded through the developing machine prior or subsequent to insertion of the wiper 8 into the rail 7. The insertion of wiper 8 subsequent to threading of the strip 3 presents no problems because the rail 7 is slotted and the carrier 9 is also slotted, i.e., the lips 11 can be caused to engage the respective sides of the strip after the strip has been trained over the guide roll 2 of FIG. 1*a*. As a rule, the minimum distance between the lips 11 of the intercepting members 10 is selected in such a way that the lips 11 are located in a common plane which is normal or substantially normal to the plane of the strip 3 therebetween. The provision of weakened portions 12 in both intercepting members 10 insures that the configuration of the lips 11 changes very little or not at all when the strip 3 is set in motion to move upwardly, as viewed in FIG. 1*a* or 2, i.e., that flexing of members 10 takes place in the region of weakened portions 12.

When the developing machine is brought to a halt, the operator can withdraw the wiper 8 from the rail 7 so that the intercepting members 10 can be readily washed or otherwise cleaned. Such removability of the wiper 8 from the rail 7 of the support 4 is particularly desirable when the liquid in the bath of the receptacle 50 tends to form crystals which would be likely to scratch the respective sides of the strip 3.

If the strip 3 tends to flutter on its way from the guide roll 2*a* toward the guide roll 2, the support 4 simply turns about the axis of the pivot member 5 so that the lips 11 of both intercepting members 10 continue to remain in contact with the respective sides of the moving strip. Thus, the support 4 then simply oscillates about the axis of the member 5 at the frequency of sidewise movement of the strip 3 on its toward the guide roll 2 whereby the force with which the free edge portions of the lips 11 bear against the respective sides of the strip remains practically unchanged. This guarantees a highly satisfactory and predictable wiping or liquid-intercepting action at both sides of the strip.

Another advantage of the turnable support 4 is that its counterweight 6 opposes movements of the rail 7 and wiper 8 from the neutral position shown in FIG. 1. Thus, the counterweight 6 damps fluttering movements of the strip 3 upstream of the guide roll 3 and during travel through the intercepting station between the lips 11.

If the strip 3 of FIGS. 1*a* and 2 is followed by a wider strip, the wider strip moves along a path which is located to the right of the path for the strip 3 of FIGS. 1 or 2 (because the wider strip is more distant from the axis of the guide roll 2). The support 4 then yields by turning slightly in a clockwise direction, as viewed in FIG. 1*a*, to insure that both lips 11 exert equal or substantially equal pressure against the respective sides of the wider strip.

The second intercepting apparatus which is mounted in or adjacent to the receptacle 50′ upstream of the guide roll 2′ is preferably identical with the intercepting apparatus of FIGS. 1*a* and 2. Therefore, all such parts of this second intercepting apparatus whch are clearly analogous to the corresponding parts of the apparatus of FIGS. 1*a* and 2 are denoted by similar reference characters each of which is followed by a prime.

If the developing machine comprises three or more receptacles, it preferably also comprises an equal number of intercepting apparatus whereby the last apparatus prevents removal of excessive quantities of liquid from the last receptacle.

In presently known liquid intercepting apparatus, the moving strip advances between two fixedly mounted elastic lips. Each of the lips normally resembles a wedge whose thickness decreases in a direction toward the path of the strip. When the strip is removed, the free edge faces of the lips are closely adjacent to each other. When the next strip enters the gap between the lips, the lips are flexed so that their innermost portions lie flat against the respective sides of the strip which reduces their ability to remove sufficient quantities of entrained liquid. Attempts to enhance the liquid-intercepting action of conventionally mounted lips by using relatively stiff and hard lips have met with little success because such lips are likely to scratch and/or otherwise adversely influence the moving strip. Moreover, a splice or another enlarged portion of a moving strip is likely to be engaged by stiff lips with a force which suffices to cause partial or complete breakage of the strip or to prevent further forward movement of the strip. In either event, the operation of the developing machine must be interrupted with resulting losses in output. The improved apparatus overcomes such drawbacks of conventional apparatus by using intercepting members 10 with relatively stiff lips 11 and readily flexible weakened portions 12 adjacent to the lips.

Figure 3:
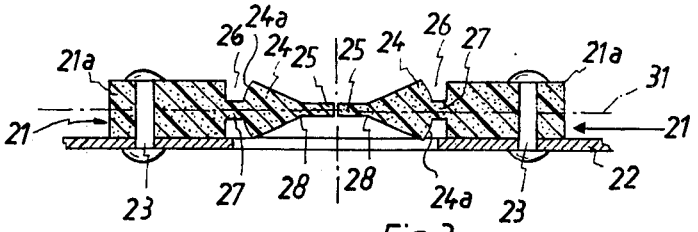
FIG. 3 is a similar sectional view of the wiper in a modified intercepting apparatus, with the liquid-intercepting members of the wiper shown in positions they assume in the absence of a strip therebetween.

FIG. 3 shows a portion of a modified liquid intercepting apparatus. The apparatus comprises a wiper including a bifurcated plate-like carrier 22 corresponding to the carrier 9 of FIG. 2, and two liquid-intercepting members 21 which are secured to the respective arms of the carrier 22 by rivets 23, screws or other suitable fasteners. The carrier 22 is insertable into the upper portion of a pendulum-shaped support in the same way as described in connection with FIGS. 1*a* abd 2; however, it is clear that the entire wiper can be fixedly secured to its pivotable support or that the means for removably securing the wiper to the support can be modified without departing from the spirit of the invention.

Figure 4:
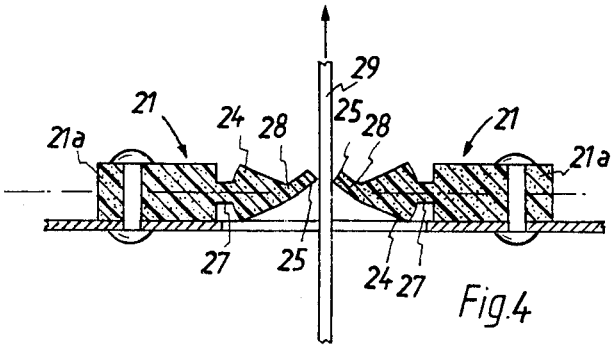
FIG. 4 shows the structure of FIG. 3 but with a moving strip between the intercepting members.
Figure 5:
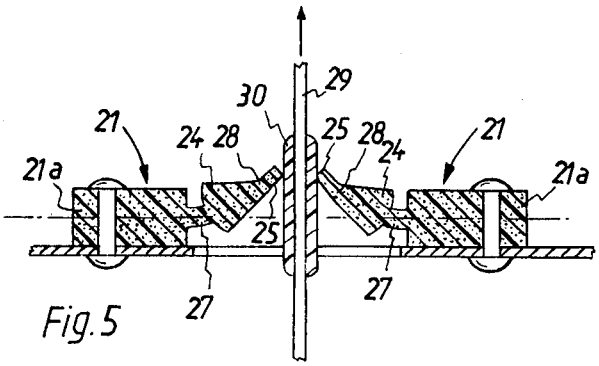
FIG. 5 shows the structure of FIG. 3 but with a splice of the moving strip between the liquid intercepting members.

Each of the intercepting members 21 comprises a relatively thick outer portion or bead 21*a* which is secured to the respective arm of the U-shaped carrier 22 and a more readily deformable lip 25 which resembles a thin lamina and comes into contact with the respective side of the moving strip 29 (shown in FIGS. 4 and 5). Still further, each intercepting member 21 comprises a wedge-like intermediate portion 24 which is located between the bead 21*a* and the lip 25 and is connected to the respetive bead by a relatively thin weakened portion or web 27 flanked by two elongated recesses or grooves 26. The thickness of the lips 25 may but need not be constant and the locations 28 where the lips 25 merge into the respective intermediate portions 24 constitute flexible joints or hinges where the lips can be pivoted relative to the adjacent intermediate portions 24. The intermediate portions 24 can be pivoted relative to the respective beads 21*a* in the region of the webs 27 which constitute second flexible joints or hinges; however, the intercepting elements 21 are preferably designed in such a way that their flexibility in the region of webs 27 is less pronounced than in the region of the joints 28, i.e., each intercepting member 21 will be flexed first at 28 and thereupon at 27 when the lips 25 are subjected to stresses tending to move them out of a common plane which is denoted by the phantom line 31 shown in FIG. 3.

As shown in FIGS. 3 to 5, the width of the recesses 26 increases in directions away from the respective sides of the corresponding webs 27 so as to allow for more pronounced flexing of intermediate portions 24 with respect to the beads 21*a*. Such flexing can be made even more pronounced if the outer (left-hand and right-hand) sides of the left-hand and right-hand intermediate portions 24 are bounded by convex surfaces (see the surfaces 24*a* in FIG. 3).

When the developing machine which embodies the wiper of FIGS. 3 to 5 is idle, i.e., when the intercepting members 21 do not engage a moving strip 3, the lips 25 assume the positions shown in FIG. 3. The neighboring edge faces of the lips 25 are very closely adjacent to but still spaced apart from each other (the width of the gap between such edge faces may be in the range of 0.1 millimeter) and the lips are preferably located in the common plane 31 which is normal to the direction of movement of strips 29 therebetween. The width of the aforementioned gap between the edged faces of the lips 25 is less than the thickness of a strip 29.

When a strip 29 is introduced between and moves relative to the intercepting members 21, the lips 25 assume the inclined positions shown in FIG. 4 because the minimal distance between these lips is less than the thickness of the strip. This means that each of the lips 25 maintains one of its edges in contact with the respective side of the moving strip 29. An optimum pressure between the lips 25 and the moving strip 29 can be achieved if the inclination of lips 25 shown in FIG. 4 relative to the lips shown in FIG. 3 is 30°–60°, most preferably about 45°.

FIG. 5 shows a splice 30 which connects two portions of the strip 29 end-to-end and is in the process of moving between the intercepting members 21. The thickness of the splice 30 normally greatly exceeds the thickness of the strip 29 so that the flexing of lips 25 at the joints 28 might not suffice to allow the splice 30 to pass. Therefore, the intercepting members 21 are flexed in the region of their webs 27 in addition to such flexing which takes place at the joints 28. This invariably enables the splice 30 to advance through the wiper. As mentioned above, the joints or webs 27 are stiffer than the joints 28 so that the flexing of intercepting members 21 in the region of the webs 27 follows the flexing at the joints 28.

The apparatus which includes the wiper of FIGS. 3 to 5 can utilize intercepting members 21 which consist of relatively stiff material. Such intercepting members can be used with advantage for interception of liquid droplets and/or films which are entrained by relatively sturdy carriers not likely to be defaced by the edges of the lips 25. The separation of liquid from the sides of a moving strip is more satisfactory if the lips are positioned in such a way that they engage the strip with the edges of their lips rather than by permitting the undersides or edge faces of the lips to lie flat against the respective sides of the moving strip. All that counts is to insure that the flexibility of selected portions of intercepting members 21 is sufficiently pronounced to enable to splice 30 or another enlarged portion of the strip to pass between the lips without breakage of the strip or to avoid stoppage of the strip in response to engagement of the leading edge of a splice with the lips. The provision of several flexible joints in each intercepting member 21 insures that a splice 30 can pass without any damage to the strip 29 even if the lips and/or other parts of the intercepting members consist of a relatively stiff material which enables the lips to remove all or nearly all surplus liquid from the moving strip.

The wiper of FIGS. 3–5 is susceptible of many modifications. For example, if the elastomeric material of the intercepting members 21 is relatively stiff or hard, the lips of such relatively stiff intercepting members can be inclined with respect to each other at all times, i.e., also when the lips do not engage a moving strip. Thus, the lips of relatively stiff liquid intercepting members amy be inclined with respect to each other in a manner as shown in FIG. 4 while the developing machine is in operation as well as when the machine is idle. The angle of inclination of stiff lips relative to the plane which is indicated by the phantom line 31 of FIG. 3 may be in the range of 30°–40°. It has been found that the liquid wiping or intercepting action of such inclined lips is at least as satisfactory as the wiping action of more elastic lips or of lips which normally assume the positions shown in FIG. 3. All that counts is to select proper elastomeric materials exhibiting predictable and readily determinable characteristics, especially elasticity. Another advantage of mutually inclined lips is that their undersides are more likely to direct the intercepted liquid into a selected portion of the associated receptacle or into a container which collects the intercepted liquid. However, controlled flow of intercepted liquid off the members 21 is invariably insured due to wedge-like configuration of intermediate portions 24.

Each of the illustrated intercepting apparatus can insure satisfactory and predictable removal of liquid films and/or droplets when the moving strip is located in the predetermined path as well as when the strip abruptly moves laterally from such path, either as a result of flutter or for another reason, e.g., because a relatively wide strip is followed by a relatively narrow strip or vice versa.

Each intercepting apparatus may comprise two mobile supports 4 each of which mounts a single intercepting member. The intercepting members of the two supports engage the opposite sides of the moving strip. However, the apparatus which are shown in the drawing are preferred at this time due to their compactness and convenience of removing both intercepting members by the simple expedient of separating the common carrier from its holder on the support.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In a machine wherein elongated strips are moved seriatim lengthwise through a succession of liquid baths and wherein at least some of the strips exhibit the tendency to move sideways, particularly in a developing machine for strips of photographic material, a combination comprising a liquid-containing receptacle; devices for guiding a moving strip along a predetermined path extending through and beyond said receptacle so that the moving strip contacts the liquid in said receptacle and successive increments thereof entrain some of the liquid on leaving the contents of said receptacle; and apparatus for removing at least some entrained liquid from such increments; including wiper means having two liquid intercepting members each in contact with a different side of each increment which emerges from the liquid in said receptacle, and support means for said wiper means, at least one of said means being movable in a plane transversely of said path so as to enable said intercepting members to remain in continuous and substantially unchanged liquid-intercepting contact with the respective sides of the moving strip irrespective of eventual sidewise movement of said increments in the region of said wiper means.

2. A combination as defined in claim 1, wherein said path includes a substantially vertical portion along which said increments of the moving strip advance on leaving the contents of said receptacle, and further comprising a pivot for said support means, said support means constituting a pendulum having a first portion located above and a second portion located below said pivot, said portions being movable transversely of said portion of said path and said wiper means being supported by one of said portions.

3. A combination as defined in claim 1, wherein said wiper means is detachable from said support means and said support means includes a holder removably receiving said wiper means.

4. A combination as defined in claim 1, wherein said wiper means comprises two liquid-intercepting members disposed at the opposite sides of said path and each contacting the respective side of the moving strip, and a common carrier for said members.

5. In a machine wherein elongated strips are moved seriatim lengthwise through a succession of liquid baths and wherein at least some of the strips exhibit the tendency to move sideways, particularly in a developing machine for strips of photographic material, a combination comprising a liquid-containing receptacle; devices for guiding a moving strip along a predetermined path extending through and beyond said receptacle so that the moving strip contacts the liquid in said receptacle and successive increments thereof entrain some of the liquid on leaving the contents of said recptacle, said path including a substantially vertical portion along which said increments of the moving strip advance on leaving the contents of said receptacle; and apparatus for removing at least some entrained liquid from such increments, inclusing wiper means having at least one liquid intercepting member in contact with one side of each increment which emerges from the liquid in said receptacle, support means for said wipe means, and a substantially horizontal pivot for said support means, said support means constituting a pendulum having a first portion located above and a second portion located below said pivot, said first and second portions of said support means being movable transversely of said portion of said path so as to enable said intercepting member to remain in continuous and substantially unchanged liguid-intercepting contact with said one side of the moving strip irrespective of eventual sidewise movement of said increments in the region of said wiper means, said wiper means being supported by said upper portion of said support means and said lower portion of said support means including a counterweight arranged to normally maintain said support means in a predetermined angular position with respect to said pivot.

6. A combination as defined in claim 5, wherein the axis of said pivot is located in said portion of said path.

7. In a machine wherein elongated strips are moved seriatum lengthwise through a succession of liquid baths and wherein at least some of the strips exhibit the tendency to move sideways, particularly in a developing machine for strips of photographic material, a combination comprising a liquid-containing receptacle; devices for guiding a moving strip along a predetermined path extending through and beyond said receptacle so that the moving strip contacts the liquid in said receptacle and successive increments thereof entrain some of the liquid on leaving the contents of said receptacle; and apparatus for removing at least some entrained liquid from such increments, including wiper means having two liquid intercepting members disposed at the opposite sides of said path and each contacting the respective side of the moving strip and a common carrier for said members, and support means for said wiper means, at least one of said means being movable in a plane transversely of said path so as to enable said intercepting members to remain in continuous and substantially unchanged liquid-intercepting contact with the respective sides of the moving strip irrespective of eventual sidewise movement of said increments in the region of said wiper means, said intercepting members having elastic lips which contact the respective sides of the moving strip and have edge portions which are closely adjacent to but spaced apart from each other in the absence of a strip in said path.

8. A combination as defined in claim 7, wherein the minimum distance between said lips is approximately 0.1 millimeter.

9. In a machine wherein elongated strips are moed seriatim lengthwise through a succession of liquid baths and wherein at least some of the strips exhibit the tendency to move sideways, particularly in a developing machine for strips of photrographic material, a combination comprising a liquid-containing receptacle; devices for guiding a moving strip along a predetermined path extending through and beyond said receptacle so that the moving strip contacts the liquid in said receptacle and successive increments thereof entrain some of the liquid on leaving the contents of said receptacle; and apparatus for removing at least some entrained liquid from such increments, including wiper means having two liquid intercepting members disposed at the opposite sides of said path and each contacting the respective side of the moving strip and a common carrier for said members, and support means for said wiper means, at least one of said means being movable transversely of said path so as to enable said intercepting members to remain in continuous and substantially unchanged liquid-intercepting contact with the respective sides of the moving strip irrespective of eventual movement of said increments in the region of said wiper means, each of said intercepting members consisting at least in part of elastomeric material and including a strip-contacting lip and at least one weakened portion, the lips of said intercepting members being disposed between said path and the respective weakened portions.

10. A combination as defined in claim 9, wherein said lips and said weakened portions extend transversely of said path.

11. In a machine wherein elongated strips are moved seriatim lengthwise through a succession of liquid baths and wherein at least some of the strips exhibit the tendency to move sideways, particularly in a developing machine for strips of photographic material, a combination comprising a liquid-containing receptacle; devices for guiding a moving strip along a predetermined path extending through and beyond said receptacle so that the moving strip contacts the liquid in said receptacle and successive increments thereof entrain some of the liquid on leaving the contents of said receptacle; and apparatus for removing at least some entrained liquid from said increments, including wiper means having two liquid intercepting members located at the opposite sides of said path and each including an elastic lip provided with an edge which engages the respective side of the moving strip, each of said members further including a portion adjacent to said lip and a flexible joint between the lip and the respective portion, and support means for said wiper means, at least one of said means being movable in a plane transversely of said path so as to enable said intercepting members to remain in continuous and substantially unchanged liquid-intercepting contact with the respective sides of the moving strip irrespective of eventual sidewise movement of said increments in the region of said wiper means.

12. A combination as defined in claim 11, wherein said lips are thin laminae extending transversely of said path.

13. A combination as defined in claim 11, wherein said portion of each of said intercepting members is a wedge which tapers in a direction toward the respective lip.

14. A combination as defined in claim 13, wherein each of said intercepting members further comprises an additional portion and a second flexible joint intermediate said portions thereof.

15. A combination as defined in claim 14, wherein said second joint is a web which connects said portions to each other and is flanked by at least one recess in the respective intercepting member.

16. A combination as defined in claim 14, wherein the flexibility of said first mentioned flexible joint is more pronounced than the flexibility of the respective second joint.

17. A combination as defined in claim 11, wherein said lips are located in a common plane, at least in the absence of a moving strip therebetween.

18. A combination as defined in claim 11, wherein the lip of each of said intercepting members makes an acute angle with the plane of the moving strip therebetween.

19. A combination as defined in claim 18, wherein said acute angle is between 30° and 40°.

20. In a machine wherein elongated strips are moved seriatim lengthwise through a succession of liquid baths and wherein at least some of the strips exhibit the tendency to move sideways, particularly in a developing machine for strips of photographic material, a combination comprising a liquid-containing receptacle; devices for guiding a moving strip along a predetermined path extending through and beyond said receptacle so that the moving strip contacts the liquid in said receptacle and successive increments thereof entrain some of the liquid on leaving the contents of said receptacle; and apparatus for removing at least some entrained liquid from such increments, including wiper means having at least one liquid intercepting member in contact with one side of each increment which emerges from the liquid in said receptacle, and support means for said wiper means, at least one of said means being movable transversely of said path so as to enable said intercepting member to remain in continuous and substantially unchanged liquid-intercepting contact with said one side of the moving strip irrespective of eventual sidewise movement of said increments in the region of said wiper means, said wiper means being detachable from said support means and said support means including a slotted rail removably receiving said wiper means, said wiper means further comprising a carrier for said intercepting member and said carrier being removably received in said rail.

21. In a machine wherein elongated strips are moved seriatim lengthwise through a succession of liquid baths and wherein at least some of the strips exhibit the tendency to move sideways, particularly in a developing machine for strips of photographic material, a combination comprising a liquid-containing receptacle; devices for guiding a moving strip along a predetermined path extending through and beyond said receptacle so that the moving strip contacts the liquid in said receptacle and successive increments thereof entrain some of the liquid on leaving the contents of said receptacle; and apparatus for removing at least some entrained liquid from such increments, including wiper means having two liquid intercepting members disposed at the opposite sides of said path and each contacting the respective side of the moving strip and a bifurcated yoke having two arms each of which supports a different one of said members, and support means for said wiper means, at least one of said means being movable transversely of said path so as to enable said intercepting members to remain in continuous and substantially unchanged liquid-intercepting contact with the respective sides of the moving strip irrespective of eventual sidewise movement of said increments in the region of said wiper means.

* * * * *